US012357061B2

(12) United States Patent
Schlichtig et al.

(10) Patent No.: US 12,357,061 B2
(45) Date of Patent: Jul. 15, 2025

(54) PORTABLE OBJECT COMPRISING A MIDDLE DEVOID OF FASTENING HORNS AND A REMOVABLE BRACELET

(71) Applicant: ETA SA MANUFACTURE HORLOGÈRE SUISSE, Grenchen (CH)

(72) Inventors: Dohan Schlichtig, Aarburg (CH); Marc Schenk, Le Landeron (CH)

(73) Assignee: ETA SA MANUFACTURE HORLOGÈRE SUISSE, Grenchen (CH)

( * ) Notice: Subject to any disclaimer, the term of this patent is extended or adjusted under 35 U.S.C. 154(b) by 129 days.

(21) Appl. No.: 17/993,189

(22) Filed: Nov. 23, 2022

(65) Prior Publication Data

US 2023/0200500 A1 Jun. 29, 2023

(30) Foreign Application Priority Data

Dec. 23, 2021 (EP) ..... 21217330

(51) Int. Cl.
*A44C 5/14* (2006.01)

(52) U.S. Cl.
CPC ..... *A44C 5/147* (2013.01)

(58) Field of Classification Search
CPC ..... A44C 5/147; A44C 5/14; A44C 5/145; A44C 5/185; G04B 37/1486; G04B 37/16; A44B 11/006; Y10T 24/4782
See application file for complete search history.

(56) References Cited

U.S. PATENT DOCUMENTS 1,737,246 A * 11/1929 Jones ..... A44C 5/2047 24/616
3,019,503 A * 2/1962 Placco ..... A44C 5/14 224/179

(Continued)

FOREIGN PATENT DOCUMENTS

CN 207055004 U * 3/2018 ..... A44C 5/14
EP 0197416 A1 * 10/1986 ..... A44C 5/2042

(Continued)

OTHER PUBLICATIONS

Communication dated Oct. 24, 2023, issued in Japanese Application No. 2022-187201.

(Continued)

*Primary Examiner* — Jason W San
*Assistant Examiner* — Anna S Rashid
(74) *Attorney, Agent, or Firm* — Sughrue Mion, PLLC

(57) ABSTRACT

A portable object (1) including a case (20) having a middle (21) devoid of fastening horns and having two longitudinal cavities (110) extending in a longitudinal direction (X-X), a bracelet (30) having two ends (31), each end (31) of the bracelet (30) cooperating with a mounting interface (200) configured to removably cooperate with a longitudinal cavity (110) of the middle (21) to make it possible to mount the bracelet (30). The mounting interface (200) is one-piece and includes: elements (210) for receiving and securing one end (31) of the bracelet (30); elastic casing elements (220) for axially locking the mounting interface (200) in the longitudinal cavity (110) in the longitudinal direction (X-X); elements (230) for locking the mounting interface (200) in the longitudinal cavity (110) in a direction transverse to the longitudinal direction (X-X).

20 Claims, 3 Drawing Sheets

(56) References Cited

U.S. PATENT DOCUMENTS

| | | | | | |
|---|---|---|---|---|---|
| 3,677,449 | A * | 7/1972 | Williams | A44C 5/147 | 224/179 |
| 3,908,243 | A * | 9/1975 | Lou | A44C 5/2061 | 24/653 |
| 4,234,115 | A * | 11/1980 | Williams | A44C 5/145 | 224/179 |
| 5,106,004 | A * | 4/1992 | Nguyen | A41F 9/002 | 224/163 |
| 5,215,235 | A * | 6/1993 | Maekawa | A44C 5/147 | 368/282 |
| 8,240,011 | B2 * | 8/2012 | Chevrolet | G04B 37/1493 | 24/265 B |
| 9,049,894 | B2 * | 6/2015 | Wong | A41F 1/006 | |
| 10,058,148 | B1 * | 8/2018 | Wittenberg | A44C 5/2057 | |
| 10,058,149 | B1 * | 8/2018 | Wittenberg | G04G 17/06 | |
| 10,219,591 | B2 * | 3/2019 | Hatanaka | G04B 37/1486 | |
| 11,903,459 | B2 * | 2/2024 | Schlichtig | A44B 11/2596 | |
| 11,998,091 | B2 * | 6/2024 | Lui | G04B 37/0008 | |
| 2011/0113599 | A1 * | 5/2011 | Ehrsam | G04B 37/1486 | 24/700 |
| 2016/0037877 | A1 * | 2/2016 | Perkins | A44C 5/147 | 224/164 |
| 2017/0181510 | A1 * | 6/2017 | Novak | A44C 15/0025 | |
| 2017/0265607 | A1 * | 9/2017 | Hatanaka | G04B 37/1486 | |
| 2018/0090890 | A1 * | 3/2018 | Kallman | H01R 13/745 | |
| 2018/0125178 | A1 * | 5/2018 | Perkins | A44B 11/263 | |
| 2020/0142358 | A1 * | 5/2020 | Taniguchi | A44C 5/14 | |
| 2020/0323316 | A1 * | 10/2020 | Lui | A44C 5/145 | |
| 2020/0383434 | A1 * | 12/2020 | Chung | A44C 5/0053 | |
| 2020/0390202 | A1 * | 12/2020 | Xue | G04B 37/1486 | |
| 2020/0393797 | A1 * | 12/2020 | Hu | G04B 37/1486 | |
| 2020/0405017 | A1 * | 12/2020 | Hu | G04B 37/1486 | |
| 2021/0015220 | A1 * | 1/2021 | Xue | A44C 5/14 | |
| 2021/0085041 | A1 * | 3/2021 | Schlichtig | G04B 37/22 | |
| 2022/0053894 | A1 * | 2/2022 | Rosengarten | A44C 5/147 | |
| 2023/0000218 | A1 * | 1/2023 | Sheng | A44C 5/14 | |
| 2023/0119270 | A1 * | 4/2023 | Cazalet | A44C 5/147 | 368/282 |
| 2024/0156217 | A1 * | 5/2024 | Aivaz | A44C 5/0069 | |

FOREIGN PATENT DOCUMENTS

| | | | | |
|---|---|---|---|---|
| EP | 0471834 | B1 * | 7/1994 | G04B 37/1486 |
| EP | 2322997 | A1 * | 5/2011 | A44C 5/02 |
| EP | 3455679 | B1 * | 2/2020 | A44C 5/14 |
| FR | 2.206.060 | A1 | 6/1974 | |
| FR | 2206060 | A * | 7/1974 | A44C 5/14 |
| FR | 3021128 | A1 * | 11/2015 | A44C 5/147 |
| JP | 61-147014 | U | 9/1986 | |
| JP | 6-82590 | U | 11/1994 | |
| JP | 8-271657 | * | 10/1996 | |
| JP | 8-271657 | A | 10/1996 | |
| JP | 2000253913 | A * | 9/2000 | |
| JP | 2019174305 | A * | 10/2019 | |
| KR | 10-2020-0110032 | A | 9/2020 | |
| WO | WO-9734720 | A1 * | 9/1997 | B22F 3/22 |
| WO | WO-2021058213 | A1 * | 4/2021 | G04B 37/1486 |

OTHER PUBLICATIONS

Anonymous Tiffanie, "Bracelet Miyuki motif eventail avec barrettes fleurs dorees et fermoir aimante—Perles & Co", Internet: https://www.perlesandco.com/tutoriels/t16581-bracelet-miyuki-motif-a-ventail-avec-barrettes-fleurs-dora-es-et-fermoir-aimanta.html, Nov. 6, 2020, <XP055937468>.

European Search Report for EP 21 21 7330, dated Jul. 1, 2022.

* cited by examiner

PORTABLE OBJECT COMPRISING A MIDDLE DEVOID OF FASTENING HORNS AND A REMOVABLE BRACELET

CROSS REFERENCE TO RELATED APPLICATIONS

This application claims priority to European Patent Application No. 21217330.6 filed Dec. 23, 2021, the entire contents of which are incorporated herein by reference.

TECHNICAL FIELD OF THE INVENTION

The present invention relates to a portable object comprising a case and a bracelet connected to the case, intended to be worn on the wrist of the user. The invention more particularly relates to a removable attachment device for removably attaching the bracelet to the case of the portable object, making it possible to facilitate the mounting and dismantling of the bracelet.

The invention more particularly relates to a wristwatch comprising a watch case devoid of fastening horns and a bracelet connected to said watch case, via a removable attachment device.

TECHNOLOGICAL BACKGROUND

The attachment devices making it possible to fasten a bracelet on a watch case are generally fairly complex, both by the number of different parts that they require for the assembly and by the complexity of these parts as well as their manufacturing difficulty.

In particular, the ends of each strand of the bracelet as well as the watch case must be specially shaped, machined, to be able to be assembled. In addition, the mounting of these miscellaneous elements is fairly long and consequently expensive.

The usual attachment devices are based on the presence of two horns, or other protruding elements, arranged on the rim of the middle of the watch case, of a transverse bar inserted at the end of a bracelet strand, each end of the transverse bar coming to be inserted into an orifice arranged at each horn.

This type of attachment of a bracelet on a watch case requires the use of a specific tool for the interchangeability of the bracelet. Consequently, if the user wants to change their bracelet for wear or aesthetic reasons, they are generally obliged to go to a professional to carry out this replacement operation. Thus, this operation requires time and incurs a certain cost.

From an industrial point of view, the horns, or other elements, protruding on the rim of the middle prevent the automation of many operations during the manufacture of the watch case or also during the finishing. Thus, some operations need to be performed manually in order to avoid damaging the horns or other protruding elements.

Attachment devices are known making it possible to facilitate the interchangeability of bracelets. However, these attachment devices are generally complex to produce and require the use of many inserting or connecting parts between the strand of the bracelet, the mounting interface and the watch case to ensure both the locking of the bracelet in relation to the mounting interface as well as the locking of the mounting interface with the case, such as for example by springs, blades, etc.

In addition, the attachment devices offering a simplified interchangeability of the bracelets require significant modifications of the watch case and/or of the bracelet without in as much facilitating the method for manufacturing these elements, which incurs additional costs during the manufacture.

Consequently, there is a need to improve the devices for removably attaching a bracelet on a watch case, and more generally a bracelet on a portable object, in order to remedy at least one of the limitations known and described above.

SUMMARY OF THE INVENTION

In this context, the object of the invention is to propose a portable object comprising an attachment device of simple design, fairly inexpensive, only requiring a single one-piece part to ensure the holding of the bracelet as well as the coupling and the locking of the bracelet to the case. Thus, the invention offers a "one-piece" solution that is easy to mass produce by conventional production means.

Another aim of the invention is to propose an attachment device making it possible to easily mount and dismantle the bracelet on the case by elastic casing. Thus, the user may easily change their bracelet in the event of wear, or to modify the aesthetics, without calling upon a professional.

Another aim of the invention is to propose an attachment device making it possible to easily manufacture parts, so that the bracelet and the case can be fully automated by conventional means and do not require manual repair operations of the attachment device.

The attachment device according to the invention makes it possible to propose a case where the middle is devoid of horns, and of protruding elements for the mounting of the bracelet, which makes it possible to have a case that is symmetrical and easy to automate during production. Thus, the proposed solution has economic advantages in relation to the solutions of the prior art that are more complex to manufacture and that require a larger number of operations.

To this end, the invention relates to a portable object comprising a case having a middle devoid of fastening horns and comprising two longitudinal cavities extending in a longitudinal direction X-X, a bracelet comprising two ends, each end of the bracelet cooperating with a mounting interface configured to removably cooperate with a longitudinal cavity of said middle to make it possible to mount the bracelet, characterised in that the mounting interface is one-piece and comprises:

- elements for receiving and securing one end of the bracelet;
- elastic casing elements for axially locking the mounting interface in said longitudinal cavity in the longitudinal direction X-X;
- elements for locking the mounting interface in said longitudinal cavity according to a direction transverse to the longitudinal direction X-X.

Advantageously, the mounting interface is an attached part, different from the bracelet.

Apart from the features mentioned in the preceding paragraph, the portable object according to the invention may have one or more additional features from the following, considered individually or according to all technically possible combinations:

- the mounting interface is configured to cooperate by sliding into said longitudinal cavity of said middle;
- the elements for receiving and securing one end of the bracelet are formed by two support plates spaced apart from one another of a distance making it possible to position the end of the bracelet between the two support plates;

the support plates have orifices for passing through a member for securing the bracelet;

the end of the bracelet is stitched, soldered or overmoulded on the support plates;

the elements for receiving and securing one end of the bracelet are formed by a slot receiving the end of the bracelet and by teeth or reliefs configured to be inserted and penetrate into the material of the bracelet in order to ensure its locking;

the teeth or the reliefs are arranged within the slot;

the teeth have different profiles and/or different orientations; advantageously, the orientations of the teeth are different from one another;

the slot has in free position an opening larger than the thickness of the end of the bracelet;

the external dimensions of the mounting interface close to the slot, in free position, are larger than the internal dimensions of the longitudinal cavity, the mounting interface being configured to compress elastically to reduce the opening of the slot during its insertion into the longitudinal cavity;

the elastic casing elements are formed by at least one elastic clip cooperating with at least one housing arranged in the longitudinal cavity;

the elastic casing elements are formed by two elastic clips located at the longitudinal ends of the mounting interface, the two elastic clips being configured to cooperate with two end housings arranged at the longitudinal cavity;

the elastic casing elements are formed by a central elastic clip configured to cooperate with a central housing arranged at the longitudinal cavity;

the elastic casing elements are configured to be reversible and make it possible to unlock the axial position of the mounting interface without damaging one of the elements constituting the mounting interface;

the elements for locking the mounting interface in said longitudinal cavity in a direction transverse to the longitudinal direction X-X are formed by a bearing surface cooperating with an undercut portion or a complementary stop surface of the longitudinal cavity;

the mounting interface is made of polymer material or of metal material;

the middle of the case is made of thermoplastic, preferably of polyamide 11;

the longitudinal cavity is opening so that the mounting interface can be inserted indifferently through a first end or through a second end of the cavity;

the longitudinal cavities extend over two circular segments of the middle located at 6 o'clock and at 12 o'clock.

Advantageously, the portable object is a wristwatch.

BRIEF DESCRIPTION OF THE FIGURES

The aims, advantages and features of the present invention will become apparent upon reading the following detailed description making reference to the following figures.

In all of the figures, the common elements bear the same reference numbers unless otherwise specified.

DETAILED DESCRIPTION OF THE INVENTION

Figure 1:
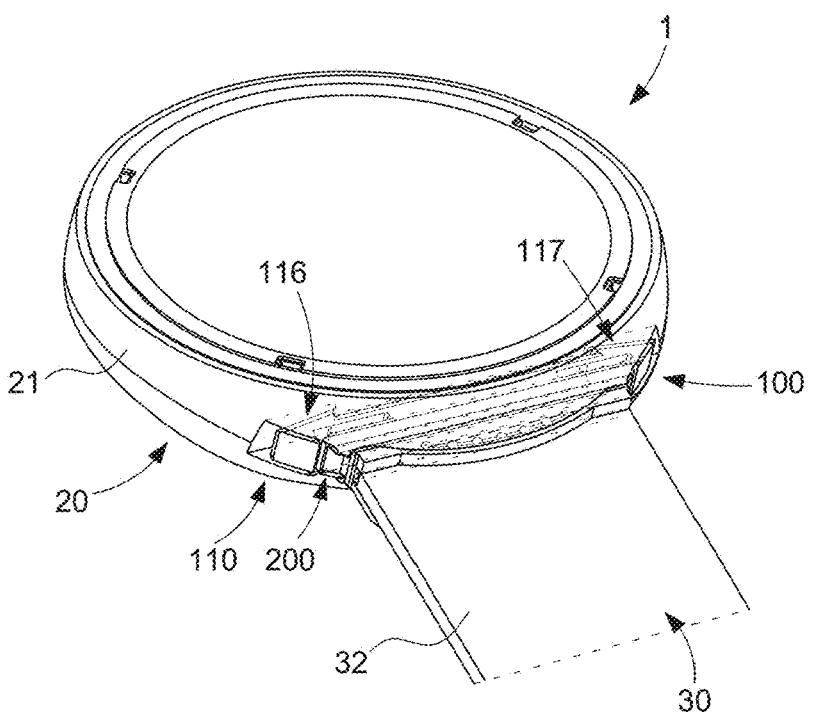
FIG. 1 shows a perspective view of a first embodiment of a portable object according to the invention.

FIG. 1 shows a perspective view of a first embodiment of a portable object 1 according to the invention.

Figure 2:
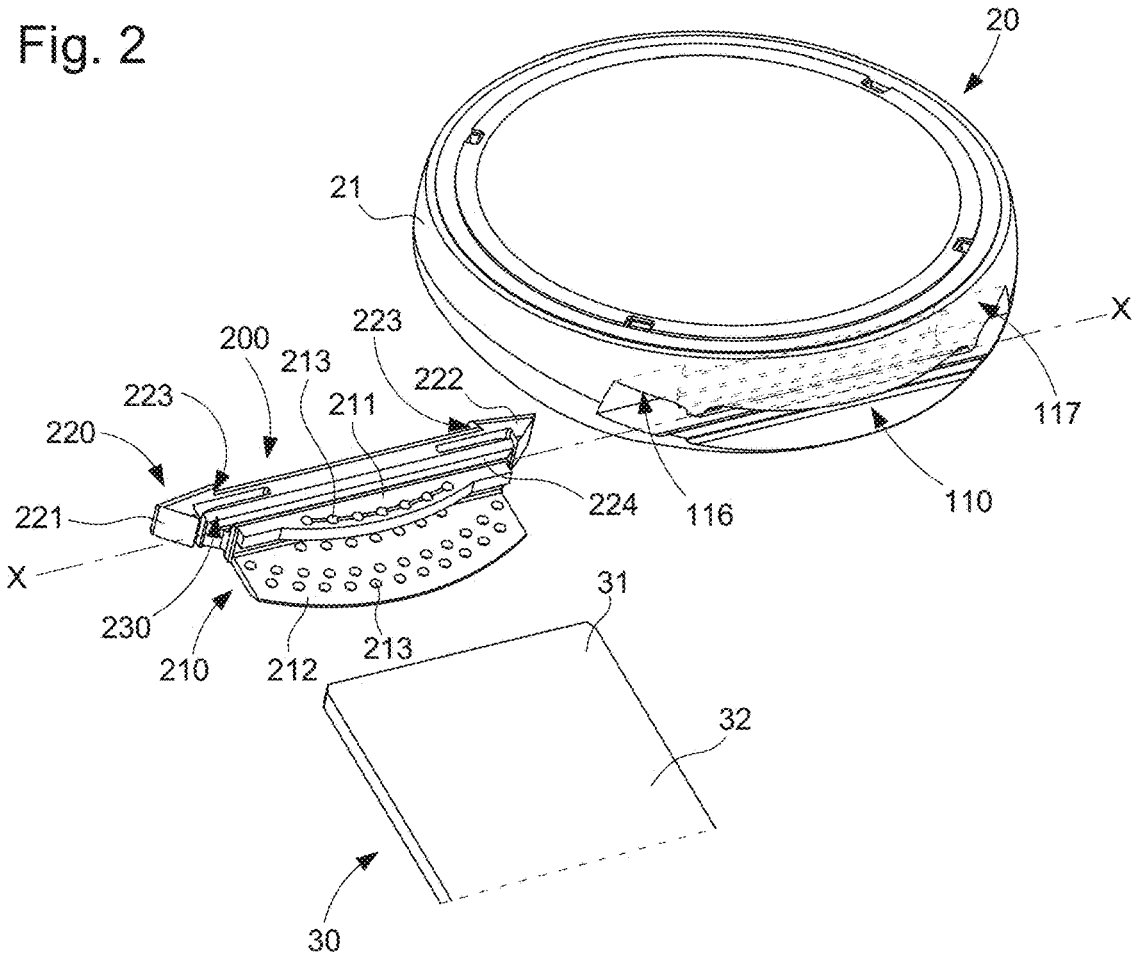
FIG. 2 shows an exploded view of the first embodiment of a portable object illustrated in FIG. 1.

FIG. 2 shows an exploded view of the first embodiment of a portable object 1 illustrated in FIG. 1, in order to see the various elements constituting the system for attaching the bracelet.

In the present application, the portable object 1 takes the form of a timepiece, such as a wristwatch intended to be worn on the wrist of the user. It will also be understood that the portable object 1 may be, for example, a pedometer, a heart rate monitor, or any other portable object intended to be worn by means of a bracelet, for example on the wrist.

The portable object 1 comprises a case 20, intended to receive for example a horological movement (not shown here for reasons of clarity). The horological movement carries and drives means for displaying an item of information, for example the current time.

The case 20 consists of a middle 21 closed by a back in the lower portion and by a crystal in the upper portion (not shown). The case 20 may also comprise a bezel (not shown) mounted on the middle 21 and that may carry the crystal, the bezel that may or may not be rotary.

The case 20 illustrated by way of example is of generally circular shape. However, the case 20 may have other known embodiments without departing from the scope of the invention.

The middle 21 is devoid of fastening horns and instead comprises two longitudinal cavities 110 (a single longitudinal cavity being visible in FIGS. 1 and 2) forming a first portion of the system for attaching 100 a bracelet 30. The longitudinal cavities 110 are configured to receive each end 31 of the bracelet 30, and more particularly to receive a mounting interface 200 integral with one end 31 of the bracelet 30, the mounting interface 200 forming the second portion of the system for attaching 100 the bracelet 30.

Each longitudinal cavity 110 arranged in the middle 21 forms a mounting slide-bar extending along a longitudinal direction X-X.

To this end, the longitudinal cavity 110 has a shape adapted to ensure a sliding connection along the longitudinal direction X-X and to block the other degrees of freedom, particularly in a direction transverse to the longitudinal direction X-X.

Each longitudinal cavity 110 is configured to cooperate with a complementary mounting interface 200, in such a way as to ensure a rapid, simple and removable mounting of the bracelet 30.

Each longitudinal cavity 110 is configured to receive by sliding the mounting interface 200 as well as to ensure a translational guidance of the mounting interface 200, along the longitudinal direction X-X, until a locking position is reached.

The longitudinal cavities 110 are produced at two fastening portions, opposite one another, located on either side of a dial (not shown), and advantageously located at 6 o'clock and at 12 o'clock.

The longitudinal cavities 110 extend over two circular segments of the middle 21 located at 6 o'clock and at 12 o'clock.

Each longitudinal cavity 110 is opening, that is to say that it is open at a first end and a second end, so that it is possible to introduce and remove each mounting interface 200, integral with the bracelet 30, through the first end as well as through the second end of the longitudinal cavity 110, that is to say through the end located on the crown side (3 o'clock side) or through the end located on the side opposite the crown (9 o'clock side).

The bracelet 30 is in the form of two strands 32 (only one being shown) connected to one another by a closing device (not shown), for example a clasp, a folding buckle or also any other ad-hoc element making it possible to perform this function of attaching the two strands 32 of the bracelet 30 around the wrist of the user.

According to one alternative embodiment, the bracelet 30 is monofilament.

The bracelet 30 is preferably flexible.

The mounting interface 200 is a one-piece part making it possible to ensure a plurality of functions.

The mounting interface 200 particularly comprises elements for ensuring the reversible securing of the bracelet 30 to the case 20 and has elements making it possible to facilitate the dismantling of the bracelet and therefore its interchangeability by the user.

To this end, the mounting interface 200 comprises elements 210 for receiving and securing one end 31 of the bracelet 30.

In this first embodiment, the elements 210 for receiving and securing one end 31 of the bracelet 30 are formed by two support plates 211, 212 spaced apart from one another, of a distance making it possible to position the end 31 of the bracelet 30 between the two support plates 211, 212. Thus the end 31 of the bracelet 30 is bordered by the two support plates 211, 212 of the mounting interface 200.

More particularly, the elements 210 for receiving and securing one end 31 of the bracelet 30 are formed by a first upper support plate 211 and by a second lower support plate 212. The two support plates 211, 212 are preferably parallel and extend in the longitudinal direction of the strand 32 of the bracelet 30.

Advantageously, the distance separating the two support plates 211, 212 is slightly smaller than the thickness of the strand 32 at its end 31, in such a way as to make it possible to position the bracelet 30 between the two support plates 211, 212, while ensuring a pre-holding of the strand 32. Such a configuration makes it possible to facilitate the operation of securing the strand 32 on the mounting interface 200.

The support plates 211, 212 have a plurality of orifices 213 for passing through or hooking one or more of the members for securing the bracelet 30. The member(s) for securing the bracelet 30 are selected depending on the material of the strand 32 of the bracelet 30 (for example made of leather, of elastic thermoplastic, of fabric, etc.).

Thus, by way of example, the end 31 of the bracelet 30 may be stitched, soldered at the orifices 213 or also directly overmoulded on the mounting interface 200.

The mounting interface 200 also comprises elastic casing elements 220 for axially locking the mounting interface 200 in said longitudinal cavity 110 in the longitudinal direction X-X.

The elastic casing elements 220 are formed by two elastic clips 221, 222 located at the longitudinal ends of the mounting interface 200. The two elastic clips 221, 222 are configured to cooperate with two end housings 116, 117 provided at the longitudinal cavity 110 to block and lock the axial position of the mounting interface 200, and therefore of the bracelet 30, along the longitudinal direction X-X.

The two elastic clips 221, 222 are symmetrical and are configured to be able to be compressed within the longitudinal cavity 110 during the mounting.

The two elastic clips 221, 222 are configured to retrieve their free position (not compressed) at the end housings 116, 117 of the longitudinal cavity 110 by elastic return. When the elastic clips 221, 222 are in free position in the end housings 116, 117, the axial movements of the mounting interface 200, in the longitudinal direction X-X, are blocked.

To this end, each elastic clip 221, 222 comprises a bearing face 223 arranged substantially perpendicular to the longitudinal direction X-X, and configured to come to abut against a lateral wall of the end housings 116, 117 of the longitudinal cavity 110.

The mounting interface 200 further comprises elements 230 for locking the mounting interface 200 in a direction transverse to the longitudinal direction X-X.

In the embodiment illustrated, this transverse direction at the longitudinal cavity 110 resembles a radial direction in relation to the centre of the case.

The elements 230 for locking the mounting interface 200 in a direction transverse to the longitudinal direction X-X are formed by a front bearing surface 224 of the mounting interface 200 cooperating with an undercut portion of the longitudinal cavity 110.

In this first embodiment, the mounting interface 200 is advantageously made of polymer material, preferably of thermoplastic material.

In this first embodiment, the mounting interface 200 is manufactured, for example, by an injection method.

To perform the dismantling of the bracelet 30, the user comes to constrain one of the elastic clips 221, 222 of the mounting interface 200, depending on the dismantling direction selected, in such a way as to deform it elastically until a compressed position is reached making it possible to release the elastic clip 221, 222 from the corresponding end housing 116, 117. Once the elastic clip 221, 222 has been released from the end housing 116, 117, the user may dismantle the bracelet 30 by sliding the mounting interface 200 out of the longitudinal cavity 110.

The elastic clips 221, 222 located at the ends of the mounting interface 200 are easily reachable by the user since they form the extension of the outer surface of the middle 21. Thus, the user may interact with the elastic clips 221, 222 simply with their finger, their nail or also a rudimentary tool easily within reach of the user, such as a pen, a paper clip, a staple, to proceed with the dismantling of the bracelet.

Figure 3:
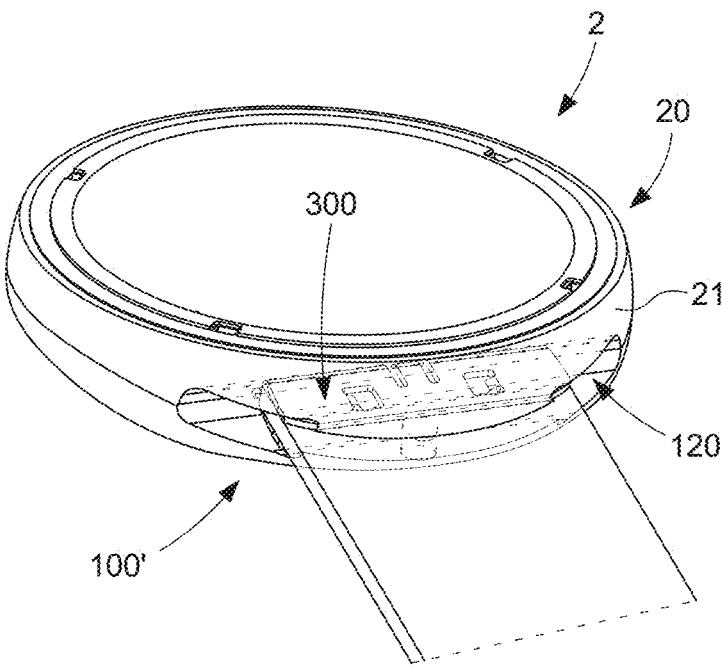
FIG. 3 shows a perspective view of a second embodiment of a portable object according to the invention.

FIG. 3 shows a perspective view of a second embodiment of a portable object 2 according to the invention.

Figure 4:
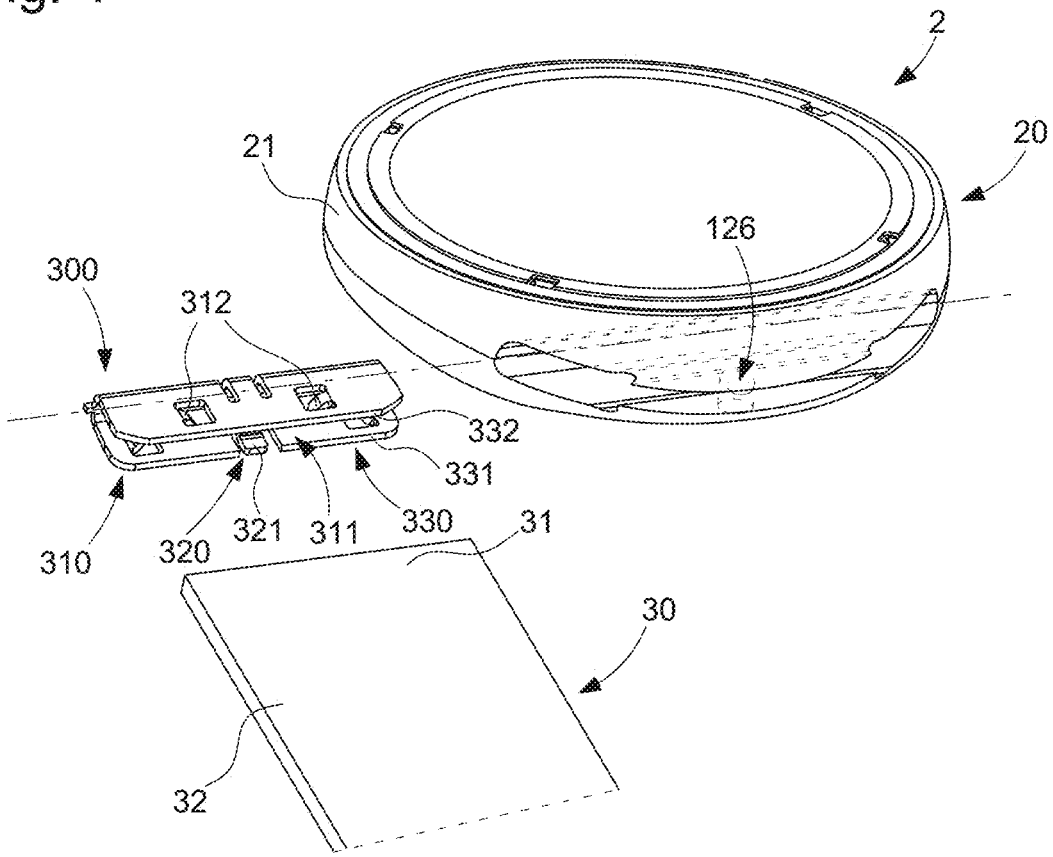
FIG. 4 shows an exploded view of the second embodiment of a portable object illustrated in FIG. 3.

FIG. 4 shows an exploded view of the second embodiment of the portable object 2 illustrated in FIG. 3, in order to display the various elements constituting the system for attaching 100' the bracelet 30.

In this second embodiment, the portable object 2 is identical to the portable object 1 described above with the exception of the features that will be described.

In this second embodiment, the mounting interface 300 is made of metal material and is manufactured for example by stamping.

The mounting interface 300 comprises elements 310 for receiving and securing one end 31 of the bracelet 30, here formed by a slot 311 making it possible to introduce the end 31 of the strand 32 of the bracelet 30 and by teeth 312 configured to be inserted and penetrate into the material of the strand 32 of the bracelet 30 in order to ensure its locking.

The teeth 312 are directed inwardly of the slot 311 and extend in the direction of the strand 32.

Advantageously, the mounting interface 300 comprises four teeth 312 distributed within the slot 311.

The teeth 312 have a profile facilitating the insertion and penetration into the material of the strand 32 of the bracelet 30.

Advantageously, the teeth 312 have different profiles and/or different orientations in such a way as to optimise the blocking of the longitudinal and transverse movements of the strands 32 within the slot 311.

Advantageously, each tooth 312 has an orientation different from the other teeth in such a way as to optimise the blocking of the longitudinal and transverse movements of the strands 32.

The mounting interface 300 comprises elastic casing elements 320 for axially locking the mounting interface 300 in the longitudinal cavity 120. The elastic casing elements 320 here are formed by a single central elastic clip 321 configured to cooperate with a central housing 126 of the longitudinal cavity 120 provided for this purpose.

The central elastic clip 321 is configured to be compressed during the introduction of the mounting interface 300 into the longitudinal cavity 120.

The central elastic clip 321 is configured to get back to its free position once the elastic clip 321 is facing the central housing 126, thus ensuring the axial locking of the mounting interface 300.

To perform the dismantling of the mounting interface 300, the case 20 comprises a hole accessible from the outside of the case by the user. This hole communicates with the central housing 126 of the longitudinal cavity 120. The hole is configured to make it possible to introduce a rudimentary tool and easily within the reach of the user, such as for example the end of a paper clip, of a staple, in order to be able to constrain the central elastic clip 321 of the mounting interface 300 in such a way as to deform it elastically until a compressed position is reached enabling the mounting interface 300 to be dismantled.

The mounting interface 300 further comprises elements 330 for locking the mounting interface 300 in a direction transverse to the longitudinal direction X-X. The elements 330 for locking the mounting interface 300 in a transverse direction are formed by front bearing surfaces 331, 332 cooperating with complementary bearing faces arranged in the longitudinal cavity 120.

Figure 5:
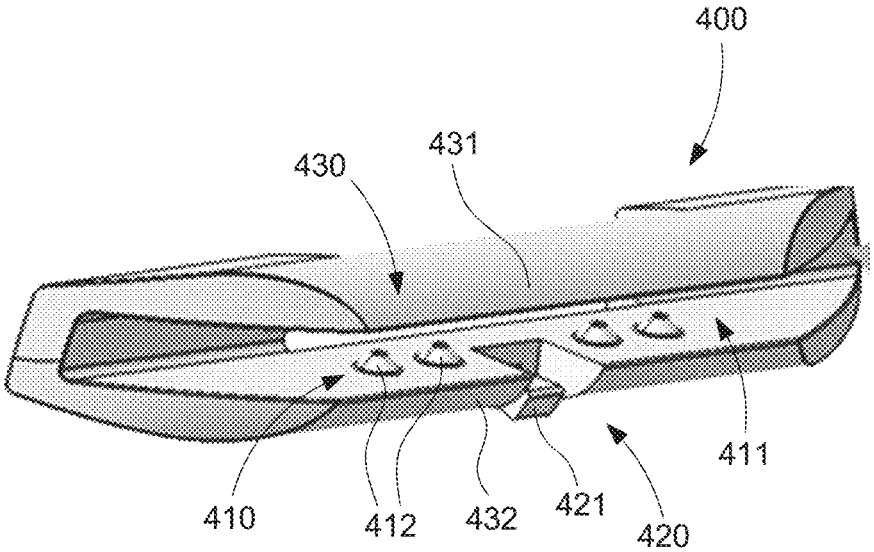
FIG. 5 shows a perspective view of a third embodiment of a mounting interface of a bracelet according to the invention.

FIG. 5 shows a perspective view of a third embodiment of the mounting interface 400 according to the invention.

In this third embodiment, the mounting interface 400 is advantageously made of polymer material, preferably of thermoplastic material.

The mounting interface 400 is manufactured, for example by an injection method.

The mounting interface 400 comprises elements 410 for receiving and securing one end 31 of the bracelet 30, which here are formed by a slot 411 making it possible to introduce the end 31 of the strand 32 of the bracelet 30 and by reliefs 412 configured to be inserted and penetrate into the material of the strand 32 of the bracelet 30. The various reliefs 412 are advantageously distributed within the slot 411.

Advantageously, the opening of the slot 411 is slightly larger than the thickness of the end 31 of the strand 32 of the bracelet 30, in such a way as to facilitate the insertion of the end 31 of the strand 32 within the slot 411.

The external dimensions of the mounting interface 400 close to the slot 411, are also slightly larger than the internal dimensions of the longitudinal cavity so that the mounting interface 400 is compressed in the longitudinal cavity, which has the effect of reducing the opening of the slot 411, of coming to pinch the strand 32 of the bracelet 30 at the slot 411, and of further introducing the reliefs 412 into the material of the strand 32. Thus, the strand 32 is held integral with the mounting interface 400 once in position in the longitudinal cavity.

In this embodiment, the bracelet 30 can be advantageously dismantled from the mounting interface 400 if necessary.

The mounting interface 400 comprises elastic casing elements 420 for axially locking the mounting interface 400 in the longitudinal cavity. The elastic casing elements 420 here are formed by a single central elastic clip 421 configured to cooperate with a central housing of the longitudinal cavity provided for this purpose.

The central elastic clip 421 is configured to be compressed during the introduction of the mounting interface 400 in the longitudinal cavity and to get back to its free position once the central elastic clip 421 is positioned facing the central housing of the longitudinal cavity.

To perform the dismantling of the mounting interface 400, the case 20 comprises a hole accessible from the outside of the case. This hole communicates with the central housing of the longitudinal cavity. The hole is configured to make it possible to introduce a rudimentary tool and easily within the reach of the user, such as for example the end of a paper clip, of a staple, in order to be able to constrain the central elastic clip 421 and to come to deform it elastically until a compressed position is reached enabling the mounting interface 400 to be dismantled.

The mounting interface 400 further comprises elements 430 for locking the mounting interface 400 in a direction transverse to the longitudinal direction X-X. The elements 430 for locking the mounting interface 400 in a transverse direction are formed by outer bearing surfaces 431, 432 cooperating with an undercut portion of the longitudinal cavity in order to ensure the blocking of the mounting interface 400 in the transverse direction.

The mounting interface 200, 300, 400 according to the invention makes it possible to perform a rapid mounting by elastic casing of the bracelet 30, reversibly, in opposition to an elastic casing system, referred to as irreversible, requiring the destruction or the deterioration of the mounting interface for dismantling the bracelet 30 from the case 20.

The mounting interface 200, 300, 400 makes it possible to perform a stable removable connection of the bracelet, particularly by a sliding connection ensuring a good stability of the mounting interface in the longitudinal cavity.

In the present invention, the middle 21 of the case 20 does not comprise any protruding element for fastening the bracelet 30. Therefore, the manufacture of the case 20 may be performed integrally in an automated way.

By way of example, the middle 21 is made of metal material or of polymer. Advantageously, the middle 21 is made of thermoplastic. By way of example, the middle 21 may be made of polyamide 11, also called polyundecanamide or nylon 11.

The middle 21 is advantageously a one-piece middle. However, it is also envisaged to produce a middle assembled from a plurality of separately manufactured parts.

Advantageously, the polymer middle is a one-piece middle produced by injection.

The portable object according to the invention as well as the system for attaching the bracelet as described in the present application makes it possible to significantly facilitate the method for producing the case, since it is devoid of fastening horns and is entirely symmetrical. Thus, the manufacture of the case and of the mounting interface may be automated. The costs of manufacturing such an assembly and of such a portable object are consequently reduced, particularly by the absence of repair operations at the case and by the use of a single interface part for fastening the bracelet.

In addition, the mounting interface according to the invention makes it possible to simplify the interchangeability of bracelets, which makes it possible to be able to easily renew your bracelet in the event of wear, or to modify the aesthetics, with a simple manipulation and without damaging the mounting interface or the case during the disassembly of the bracelet.

The invention has been described with a particular embodiment of the middle and of the mounting interfaces. However, it is obvious that other embodiments, as well as those deriving from those described, are envisaged.

The invention claimed is:

1. A portable object (1, 2) comprising a case (20) having a middle (21) devoid of fastening horns and comprising two longitudinal cavities (110, 120) extending in a longitudinal direction (X-X), a bracelet (30) comprising two ends (31), each end (31) of the bracelet (30) cooperating with a mounting interface (200, 300, 400) configured to removably cooperate with a longitudinal cavity (110, 120) of said middle (21) to make it possible to mount the bracelet (30), wherein the mounting interface (200, 300, 400) is one-piece and, as one-piece, comprises the following as unitary with each other:

elements (210, 310, 410) for receiving and securing one end (31) of the bracelet (30);

elastic casing elements (220, 320, 420), unitary with the elements (210, 310, 410), for axially locking the mounting interface (200, 300, 400) in said longitudinal cavity (110, 120) in the longitudinal direction (X-X); and elements (230, 330, 430), unitary with the elements (210, 310, 410) and the elastic casing elements (220, 320, 420), for axially locking the mounting interface (200, 300, 400) in said longitudinal cavity (110, 120) in a direction transverse to the longitudinal direction (X-X).

2. The portable object (1, 2) according to claim 1, wherein said mounting interface (200, 300, 400) is configured to cooperate by sliding into said longitudinal cavity (110, 120) of said middle (21).

3. The portable object (1) according to claim 1, wherein the elements (210) for receiving and securing one end (31) of the bracelet (30) are formed by two support plates (211, 212) spaced apart from one another of a distance making it possible to position the end (31) of the bracelet (30) between the two support plates (211, 212).

4. The portable object (1) according to claim 3, wherein said support plates (211, 212) have orifices (213) for passing through a member for securing the bracelet (30).

5. The portable object (1) according to claim 3, wherein the end (31) of the bracelet (30) is stitched, soldered or overmoulded on the support plates (211, 212).

6. The portable object (2) according to claim 1, wherein the elements (310, 410) for receiving and securing one end (31) of the bracelet (30) are formed by a slot (311, 411) receiving the end (31) of the bracelet (30) and by teeth (312) or reliefs (412) configured to be inserted and penetrate into the material of the bracelet (30) in order to ensure its locking.

7. The portable object (2) according to claim 6 wherein the teeth (312) or the reliefs (412) are arranged within the slot (311, 411).

8. The portable object (2) according to claim 6, wherein the teeth (312) have different profiles and/or different orientations.

9. The portable object (1, 2) according to claim 6, wherein the slot (411) has, in free position, an opening larger than the thickness of the end (31) of the bracelet (30).

10. The portable object (1, 2) according to claim 9 wherein the external dimensions of the mounting interface (400) close to the slot (411), in free position, are larger than the internal dimensions of the longitudinal cavity, the mounting interface (400) being configured to compress elastically to reduce the opening of the slot (411) during its insertion into the longitudinal cavity.

11. The portable object (1, 2) according to claim 1, wherein the elastic casing elements (220, 320, 420) are formed by at least one elastic clip (221, 222, 321, 421) cooperating with at least one housing (116, 117, 126) arranged in the longitudinal cavity (110, 120).

12. The portable object (1) according to claim 1, wherein the elastic casing elements (220) are formed by two elastic clips (221, 222) located at the longitudinal ends of the mounting interface (200), the two elastic clips (221, 222) being configured to cooperate with two end housings (116, 117) arranged at the longitudinal cavity (110).

13. The portable object (2) according to claim 1, wherein the elastic casing elements (320, 420) are formed by a central elastic clip (321, 421) configured to cooperate with a central housing (126) arranged at the longitudinal cavity (120).

14. The portable object (2) according to claim 1, wherein the elastic casing elements (220, 320, 420) are configured to be reversible and make it possible to unlock the axial position of the mounting interface (220, 320, 420) without damaging one of the elements constituting the mounting interface (220, 320, 420).

15. The portable object (1, 2) according to claim 1, wherein the elements (230, 330, 430) for locking the mounting interface (200, 300, 400) in said longitudinal cavity (110, 120) in a direction transverse to the longitudinal direction (X-X) are formed by a bearing surface (224, 331, 332, 431, 432) cooperating with an undercut portion or a complementary stop surface of the longitudinal cavity (110, 120).

16. The portable object (1, 2) according to claim 1, wherein the mounting interface (200, 300, 400) is made of polymer material or of metal material.

17. The portable object (1, 2) according to claim 1, wherein the middle (21) of the case (20) is made of thermoplastic, preferably of polyamide 11.

18. The portable object (1, 2) according to claim 1, wherein the longitudinal cavity (110, 120) is opening so that the mounting interface (200, 300, 400) can be inserted indifferently through a first end or through a second end of the longitudinal cavity (110, 120).

19. The portable object (1, 2) according to claim 1, wherein the longitudinal cavities (110, 120) extend over two circular segments of the middle (21) located at 6 o'clock and at 12 o'clock.

20. The portable object (1, 2) according to claim 1, wherein the portable object is a wristwatch.

* * * * *